US006580350B1

(12) United States Patent
Kobayashi

(10) Patent No.: US 6,580,350 B1
(45) Date of Patent: Jun. 17, 2003

(54) LAMINATED ELECTRONIC COMPONENT

(75) Inventor: Keiichi Kobayashi, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/541,734

(22) Filed: Apr. 3, 2000

(30) Foreign Application Priority Data

Mar. 31, 1999 (JP) ..... 11-092904

(51) Int. Cl.[7] ..... H01F 5/00
(52) U.S. Cl. ..... 336/200; 336/83; 336/192
(58) Field of Search ..... 336/83, 200, 221, 336/223, 232, 192, 208

(56) References Cited

U.S. PATENT DOCUMENTS 3,812,442 A * 5/1974 Muckelroy ..... 336/83
4,543,553 A * 9/1985 Mandai et al. ..... 336/83

FOREIGN PATENT DOCUMENTS

| | | | |
|---|---|---|---|
| JP | 5-135949 | * | 6/1993 |
| JP | 6-53050 | * | 2/1994 |
| JP | 6-69040 | * | 3/1994 |

* cited by examiner

*Primary Examiner*—Lincoln Donovan
*Assistant Examiner*—Tuyen T. Nguyen
(74) *Attorney, Agent, or Firm*—Katten Muchin Zavis Rosenman

(57) ABSTRACT

A laminated electronic component having a plurality of insulating layers, each of which is provided with a conductive patterns forming an internal electrode, includes an elongated through-hole elongated along a length of the conductive pattern and connecting the conductive patterns on different insulating layers.

8 Claims, 8 Drawing Sheets

LAMINATED ELECTRONIC COMPONENT

FIELD OF THE INVENTION

The present invention relates to a laminated electronic component; and, more particularly, to a laminated electronic component including a plurality of dielectric sheets laminated on top of another, each of the sheets having a conductive pattern, and through-holes, wherein each of the through-holes having an elongated shape along a lengthwise direction of the conductive pattern, and the conductive patterns are electrically connected through the through-holes.

DESCRIPTION OF THE PRIOR ART

A prior art laminated inductor is disclosed in FIGS. 9 and 10, wherein FIG. 9 offers an exploded perspective view of the laminated inductor and FIG. 10 gives a top planar view of a ferrite sheet incorporated therein.

The laminated inductor is provided with a laminated body of a substantially rectangular shape having therein internal electrodes forming a coil and a pair of external electrodes formed at both ends of the laminated body, respectively, the external electrodes being electrically connected to the internal electrode. The internal electrode forms the coil which is wound to allow a direction of a magnetic flux generated by the coil to be substantially identical to a direction in which the external electrodes are connected. Both ends of the coil are extracted out of the laminated body to be connected to the external electrodes, respectively.

The laminated body is made of magnetic material such as a ferrite. As shown in FIG. 9, the laminated body 101 is formed by pressing the plurality of the laminated ferrite sheets in a direction in which the external electrodes are connected. A conductive pattern 103 is formed on each of the ferrite sheets 102. The conductive patterns on the vertically adjacent sheets are electrically connected to one another through the through-hole 104. The conductive pattern is formed by applying a conductive paste on the ferrite sheet 102 having the through-hole 104. During the applying of the conductive paste, the conductive paste is charged through the through-hole 104. Accordingly, an electrical connection is achieved between the vertically adjacent ferrite sheets 102.

As shown in FIG. 10, the conductive pattern 103 has a substantially one end-opened rectangular shape at a center of each of the ferrite sheets, with one end thereof having a land 105 for an electrical connection with the through-hole 104. Further, the conductive pattern 103 is formed to have only the land 105 at both ends of the laminated body in order to extract the coil to a surface of the laminated body.

In such an inductor, it is important to guarantee a stable electrical connection between the conductive patterns through the through-hole. Especially, in the laminated inductor where the ferrite sheets are laminated and pressed in a direction in which the external electrodes are connected, it is difficult to guarantee the stable electrical connection, since the number of electrical connections through the through-hole is increased. Important cause of the unstable connection in the electrical connection through the through-hole may result from a misalign of the ferrite sheets therebetween. The misalign of one ferrite sheet from other ferrite sheet may further reduce a contact area between the conductive pattern and the through-hole, which causes the contact resistance to increase, thereby permitting a reduced amount of the current to be flown therethrough.

In order to solve such problem, the prior art laminated inductor 100 has the land 105 formed around a portion which is connected through the through-hole 104. A diameter of the land 105 is larger than a width of the conductive pattern serving as the coil; and is large enough to surround the through-hole 104. In this configuration, the electrical connection together with the necessary contact area between the land 105 and the through-hole 104 can be stably guaranteed, even if the ferrite sheets are misaligned with one another within an acceptable range.

In the prior art laminated inductor, however, the conductive pattern 103 does not have an ideal shape forming the coil due to the shape of the land 105; and a self resonant frequency($f_0$) is reduced due to an increase of a floating capacity between the land 105 and the external electrode.

SUMMARY OF THE INVENTION

It is, therefore, a primary object of the invention to provide a laminated electronic component wherein an stable electrical connection between electrodes can be guaranteed, maintaining its electrical properties.

The above and other objects of the invention are accomplished by providing a laminated electronic component having a plurality of insulating layers each of which is provided with a conductive patterns forming an internal electrode, said component comprising an elongated through-hole elongated along a length of the conductive pattern and connecting the conductive patterns on different insulating layers.

In the laminated inductor constructed in this manner, since the elongated through-hole is a hole elongated along a length of a branch of the coil conductive pattern, the electrical connection between the coil conductive patterns or between a coil conductive pattern and a lead conductive pattern can be maintained without necessitating a land for connecting to the normal through-hole. For this reason, increasing of a floating capacitance or reduction of a self-resonant frequency which may occur due to an existence of the land can be prevented. This configuration can cover more serious degrees of misalignment between the insulating layers, maintaining a sufficient contact area between the conductive patterns.

In accordance with another feature of the present invention, in the laminated electronic component, a lengthwise direction of the elongated through-hole is at a right angle with a direction of the conductive pattern formed on a directly lower insulating layer than that having the elongated through-hole. The present invention can accommodate a misalignment between the elongated through-hole and the insulating layers, maintaining a sufficient contact area therebetween.

In accordance with another feature of the present invention, in the laminated electronic component, the plurality of internal electrodes form a coil. Further, the laminated electronic component further comprises a pair of external electrodes being electrically connected to both ends of the coil, respectively, the external electrodes positioned parallel to a direction of a magnetic flux generated by the coil.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
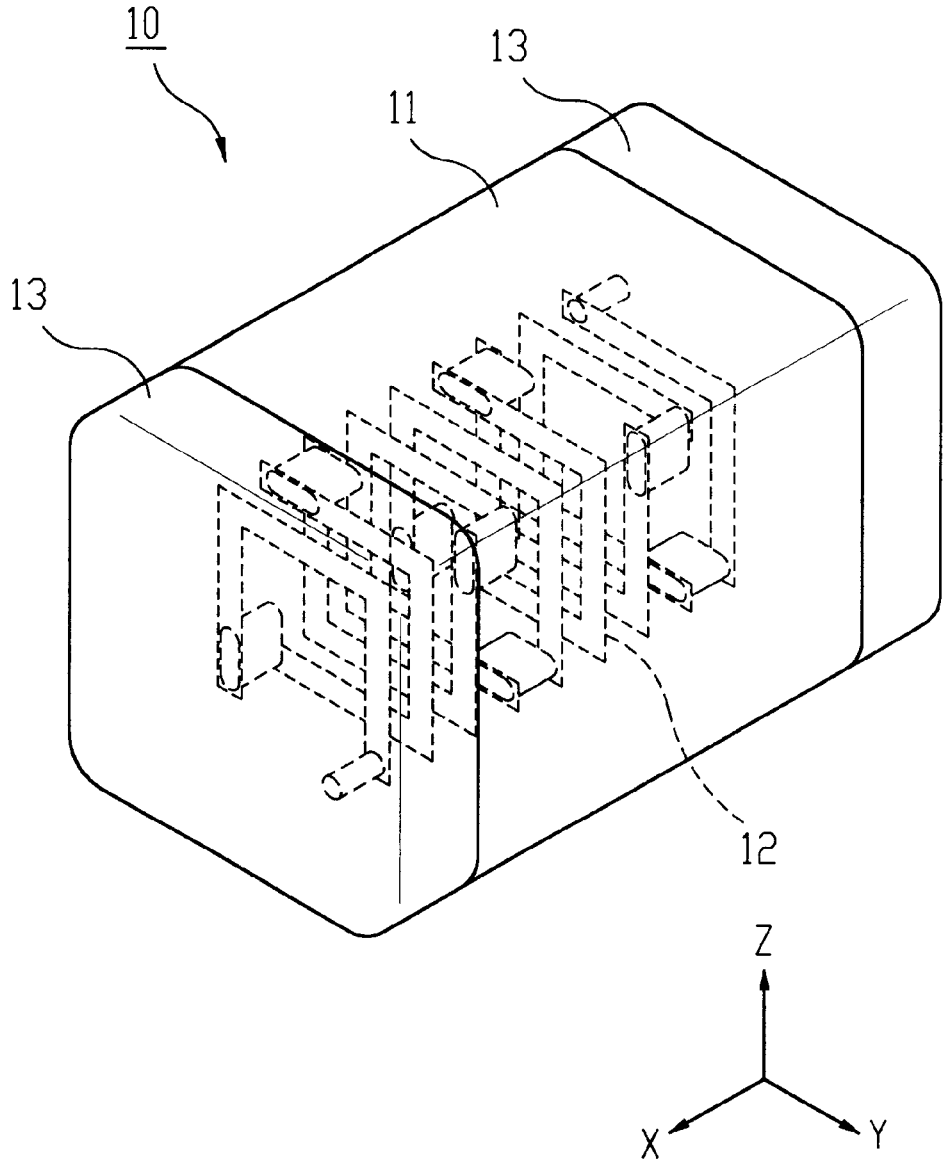
FIG. 1 illustrates a perspective view of a laminated body of a laminated inductor in accordance with a first embodiment of the present invention.

Now, a laminated electronic component in accordance with a first embodiment of the present invention is described with reference to FIGS. 1 through 3. In the first embodiment, a laminated inductor will be described as one example of the inventive laminated electronic components. FIG. 1 shows a perspective view of a laminated body of the laminated inductor; and FIG. 2 illustrates an exploded perspective view of the laminated body, with FIG. 3 offering a top planar view of a ferrite sheet.

As shown in FIG. 1, the laminated inductor 10 is provided with a laminated body 11 of a substantially rectangular box shape having a plurality of internal electrodes 12 therewithin, and a pair of external electrodes 13 formed at both ends of the laminated body 11 and electrically connected to the internal electrode 12. The internal electrode 12 forms the coil which is wound to allow a direction of a magnetic flux generated by the coil to be substantially identical to a direction in which the external electrodes 13 are connected, i.e., a direction X in FIG. 1. Both ends of the coil are extracted out of the laminated body 11 to be connected to the external electrodes 13, respectively.

The laminated body is made of magnetic material such as a ferrite. As shown in FIG. 2, the laminated body 11 is formed by pressing the plurality of the ferrite sheets 20 arranged vertically in a direction in which the external electrodes 13 are connected, i.e., X-direction, and then by firing them. A coil conductive pattern 30 for forming a coil is formed on each of the ferrite sheets 20 at a center of the laminated body 11, whereas a lead conductive pattern 31 functioning as a lead line for introducing one end of the coil out of a surface of the laminated body 11, is formed on each of the ferrite sheets 20 near both ends of the laminated body 11. The coil conductive patterns 30 or the lead conductive patterns 31 on the vertically adjacent ferrite sheets 20 are electrically connected to one another through through-holes 40 and 41.

Figure 2:
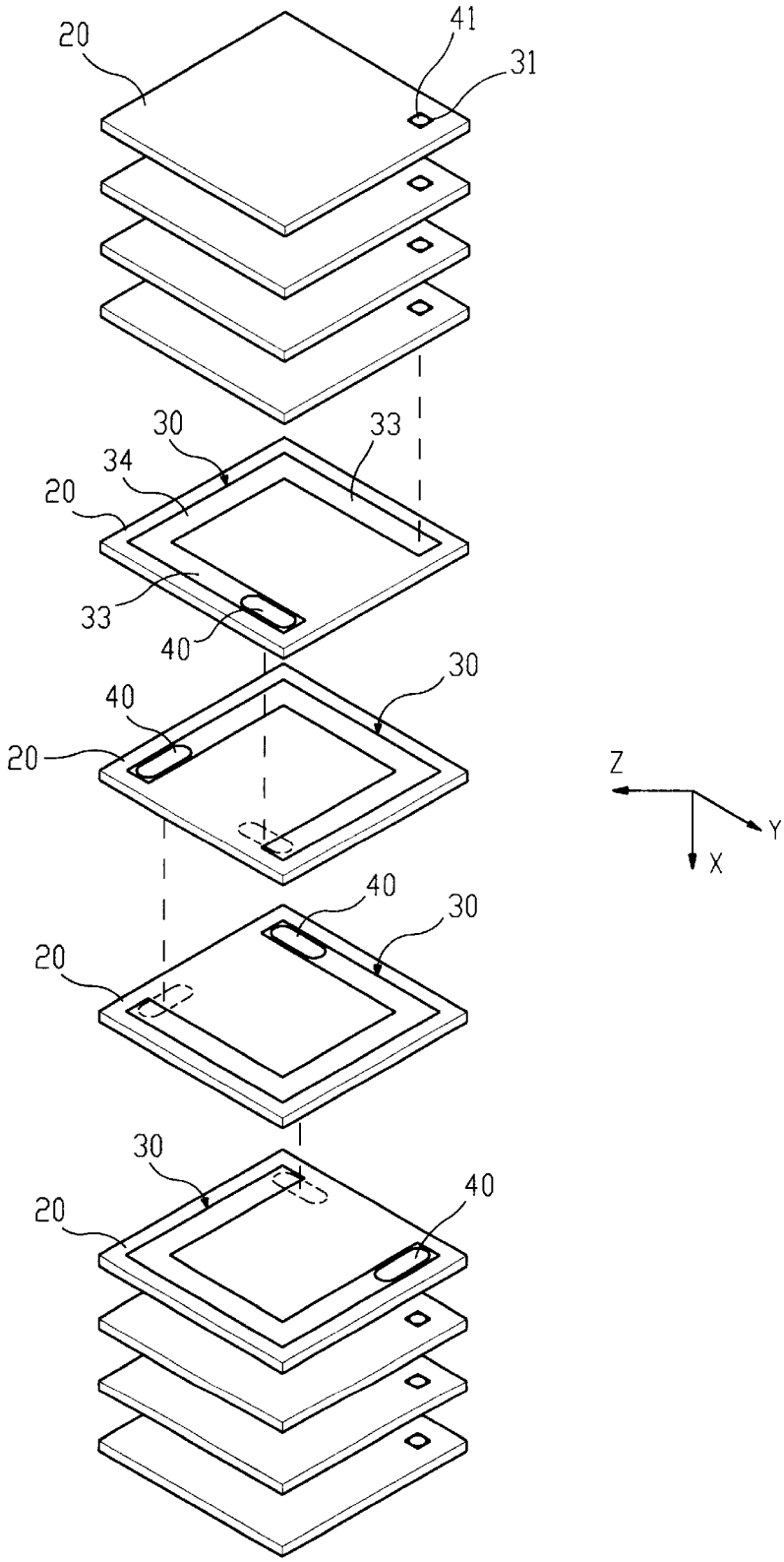
FIG. 2 depicts an exploded perspective view of the inventive laminated inductor.
Figure 3:
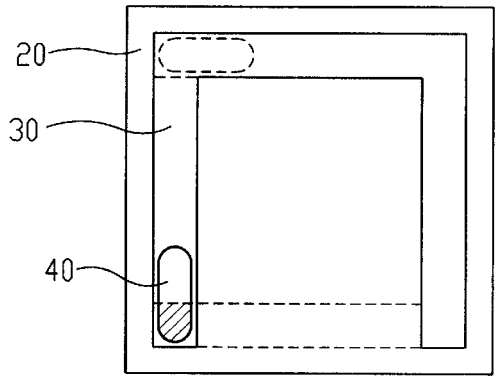
FIG. 3 shows a top planar view of a ferrite sheet.

As shown in FIGS. 2 and 3, the coil conductive pattern 30 has a predetermined width and a substantially rectangular shape opened in one direction, two branches 33 and a bridge 34. One end of one branch 33 of the coil conductive pattern 30 has the elongated through-hole 40 formed therethrough by which the conductive pattern 30 is electrically connected to the coil conductive pattern 30 or the lead conductive pattern 31 on the lower ferrite sheet 20. The other end of the branch 33 of the coil conductive pattern 30 is electrically connected to the coil conductive pattern 30 or the lead conductive pattern 31 on the upper ferrite sheet 20 via the through-hole 40 or 41 formed through the upper ferrite sheet 20. The two coil conductive patterns 30 on two ferrite sheets 20 vertically adjacent to each other, respectively, have such a configuration that an open direction of the one coil conductive pattern is rotated by 90 degree with respect to that of the other coil conductive pattern 30. In this manner, all the coil conductive patterns 30 on the ferrite sheets 20 are electrically connected to one another to form a helical shape having an axis in parallel with the direction in which the external electrodes are connected, i.e., X-direction. As a result, the coil is formed by the internal electrodes 12.

As shown in FIG. 2, the lead conductive pattern 31 is formed to have a land-shape configuration. Each of the lead conductive patterns 31 has the through-hole 41 formed through a center thereof. Two lead lines, each of which introduces one end of the coil out of the surface of the laminated body 11, are formed by all of the lead conductive patterns 31.

As shown in FIG. 3, the elongated through-hole 40 is an elongated opening formed through the coil conductive pattern 30, which has a length and a width. A diameter or a width of the elongated through-hole 40 has a size for allowing the elongated through-hole 40 to be surrounded by the coil conductive pattern 30. The elongated through-hole 40 may be a rectangular shape or an oval shape or an elongated oval shape. The length of the elongated through-hole 40 complies with that of the branch 33 of the coil conductive pattern 30. A same material as that charged in the coil conductive pattern 30 is charged in the through-hole 30. The coil conductive pattern 30 on the ferrite sheet 20 having the through-hole 30 is electrically connected to the coil conductive pattern 30 or the lead conductive pattern 31 on the lower ferrite sheet 20 via the through-hole 30. In FIG. 3, a dotted line represents a through-hole in a lower position; and a hatched area indicates a contact surfaces between the through-hole and the coil conductive pattern 30.

The through-hole 41 is formed through a center of the lead conductive pattern 31. A diameter of the through-hole 41 is a substantially half of that of the lead conductive pattern 31. In a similar manner to the elongated through-hole 40, the through-hole 41 is charged with a same material as that charged in the lead conductive material.

Returning to FIG. 1, the external electrodes 13 are electrically connected to the internal electrodes 12 introduced out of the surfaces of the laminated body 11. One surface of the laminated body 11 is contacted to the lead conductive pattern 31 on the uppermost ferrite sheet 20, while the other being contacted to the through-hole 41 on the lowermost ferrite sheet 20.

A method for manufacturing the inventive laminated inductor 10 will now be described.

First, the ferrite sheet 20 is formed. To be more specific, ferrite fine powders are first obtained by mixing $FeO_2$, CuO, ZnO, NiO in an appropriate ratios, calcining at an appropriate temperature and then pulverized. The ferrite powders thus obtained are then mixed with ethyl cellulose and terpineol to form a ferrite paste to be formed into the ferrite sheet by using, e.g., a doctor blade or the like.

Next, the elongated through-hole 40 or the through-hole 41 is formed through the obtained ferrite sheet 20 by way of blanking which uses a metal mold or a laser-based machining. Next step is to print a conductive paste on the ferrite sheet 20 in a predetermined pattern. The conductive paste is printed in such a manner that the ferrite sheet 20 with the elongated through-hole 40 formed therethrough has the coil conductive pattern 30, while the ferrite sheet 20 with the through-hole 41 having the lead conductive pattern 31. A metal paste having, e.g., Ag, as a main component is preferable as the conductive paste.

Next, those ferrite sheets are vertically aligned to one another and then pressed to allow the conductive patterns on those ferrite sheets to be electrically connected to one another through the elongated through-hole 40 and the through-hole 41, resulting in "a laminated sheet body". The laminated sheet body is diced into "green" laminated bodies.

Next, the green laminated bodies are heated in air at a temperature of 400° C. for about 2 hours to remove a binder therefrom; and are then sintered in air at a temperature of 850~900° C. for about 2 hours, to form the laminated body 11 having the embedded internal electrodes.

Next, the conductive paste is applied on both ends of the laminated body 11 by way of a dualin-linepackage method and then fired in air for 2 hours at a temperature of 800° C. As a result, the external electrodes 13 are obtained. A same material as that forming the internal electrodes 12 may be used to form the external electrodes 13. Finally, the external electrodes 13 are plated to obtain the laminated inductor 10.

In the laminated inductor constructed in this manner, since the elongated through-hole 40 is a hole elongated along the length of the branch 33 of the coil conductive pattern 30, the electrical connection between the coil conductive patterns 30 or between the coil conductive pattern 30 and the lead conductive pattern 31 can be maintained without necessitating a land for connecting to the normal through-hole. For this reason, increasing of the floating capacitance or reduction of the self-resonant frequency which may occur due to an existence of the land can be prevented.

Figure 4A:
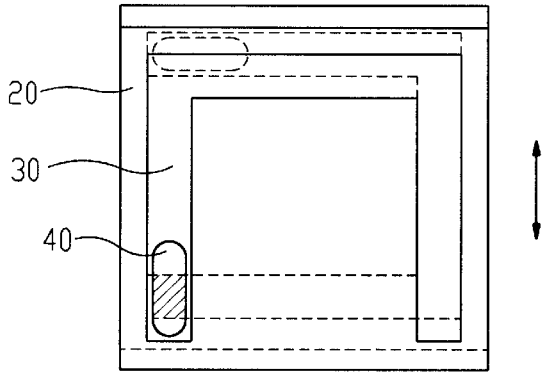
FIGS. 4A and 4B present sectional views of the laminated body, respectively.
Figure 4B:
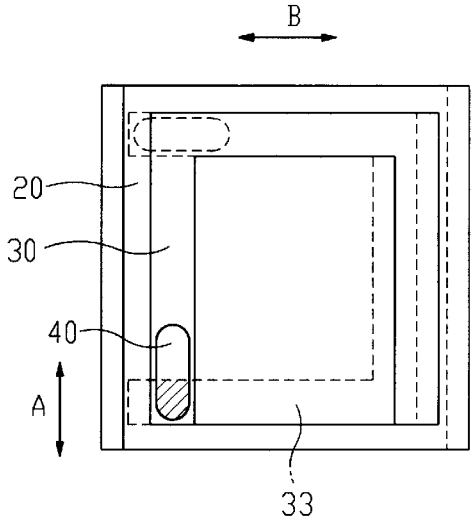

Further, as shown in FIGS. 4*a* and 4*b*, the elongated shape of the elongated through-hole 40 ensures an increased contact area, even if the ferrite sheets 20 are slightly misaligned from one another in directions indicated with arrows. In FIGS. 4*a* and 4*b*, hatched portions represents the contact area between the conductive patterns 30 and the elongated through-hole 40.

Further, as shown in FIG. 4*b*, since the lengthwise direction of the elongated through-hole 40, i.e., A-direction, is at right angle with the direction of the branch 33 of the coil conductive pattern indicated with the dotted line, i.e., B-direction, which is formed on the lower ferrite sheet 20 than that having the elongated through-hole 40, this configuration ensure an increased contact area.

Figure 9:
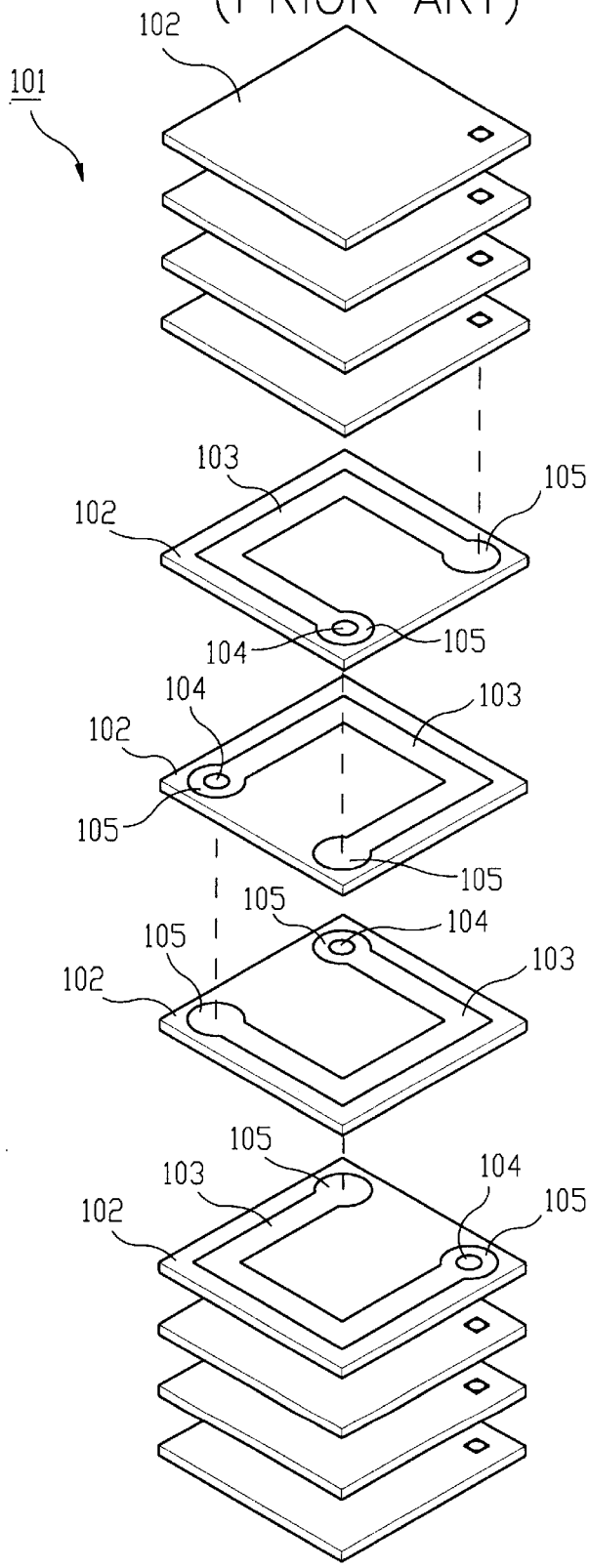
FIG. 9 (PRIOR ART)
FIGS. 9 and 10 show an exploded perspective view and a top planar view of the prior art laminated body.
Figure 10:
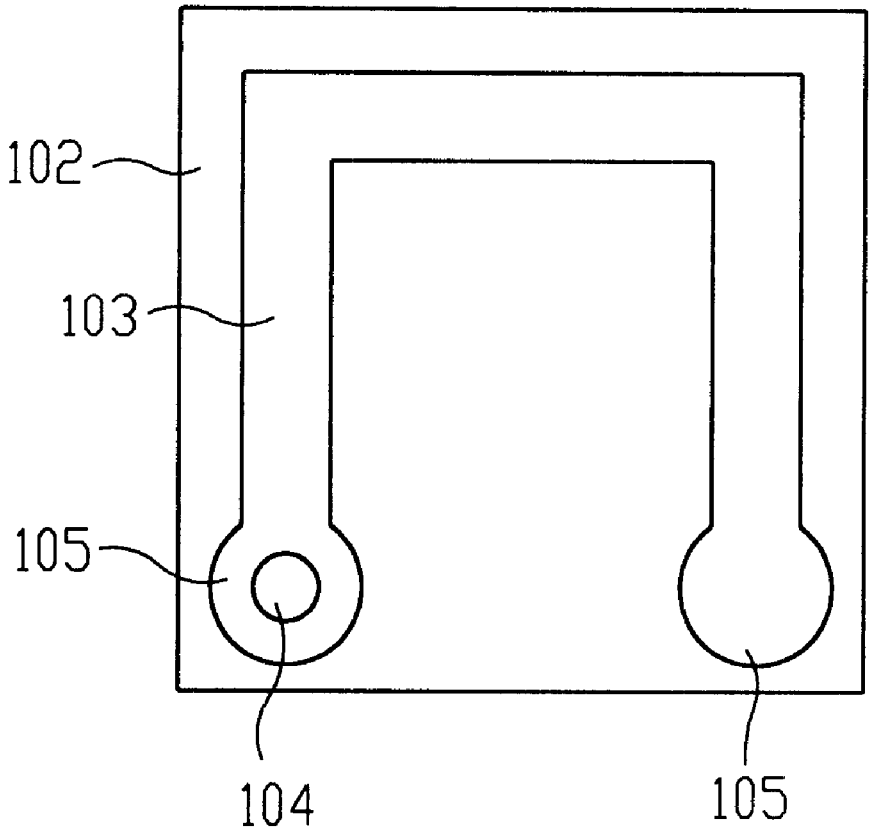
FIG. 10 (PRIOR ART)

200 samples of the laminated inductor having a size of 2.1 mm×2.1 mm×2.5 mm in its appearance and made in accordance with the above are prepared, wherein the width of the branch 33 is 200 $\mu$m, the number of turns of the coil is 5 and the elongated through-hole 40 of an oval type has a length of 300 $\mu$m and the width of 160 $\mu$m; and then a test is performed thereto to measure various electrical properties. For more proper comparison between the prior art laminated inductor described in reference to FIGS. 9 and 10 and the inventive laminated inductor, the same number of the prior art laminated inductor as that of the inventive laminated inductor are prepared, wherein the diameter of the land is 260 $\mu$m and the diameter of the through-hole is 220 $\mu$m. The size, the number of turns of the coil and the material of the prior art laminated inductor are identical to those of the inventive laminated inductor.

TABLE 1

| | L value [$\mu$H] | Resistance value against DC [$\mu\Omega$] | Contact area [$\mu m^2$] | Breakdown current [mA] | Self-resonant frequency [MHz] |
|---|---|---|---|---|---|
| Inventive laminated inductor | 22.1 | 193 | 58496 | 1720 or higher | 812 |
| Prior art laminated inductor | 21.5 | 278 | 37994 | 1350 or higher | 656 |

As shown in Table 1, the inventive laminated inductor has a lower resistance value against a direct current, a lower possibility of bad electrical connection, a higher endurable maximum current and a higher self-resonant frequency, without its productivity being detrimentally affected.

Figure 5:
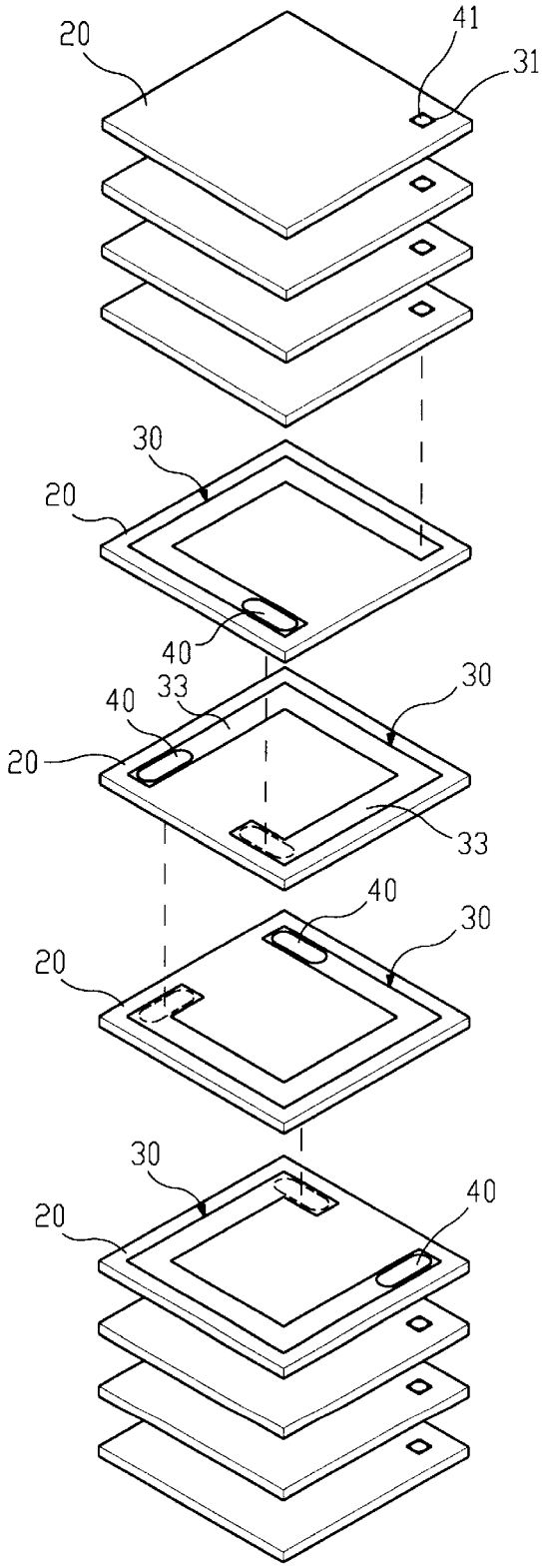
FIG. 5 shows an exploded perspective view of a modified conductive pattern of the laminated body.
Figure 6:
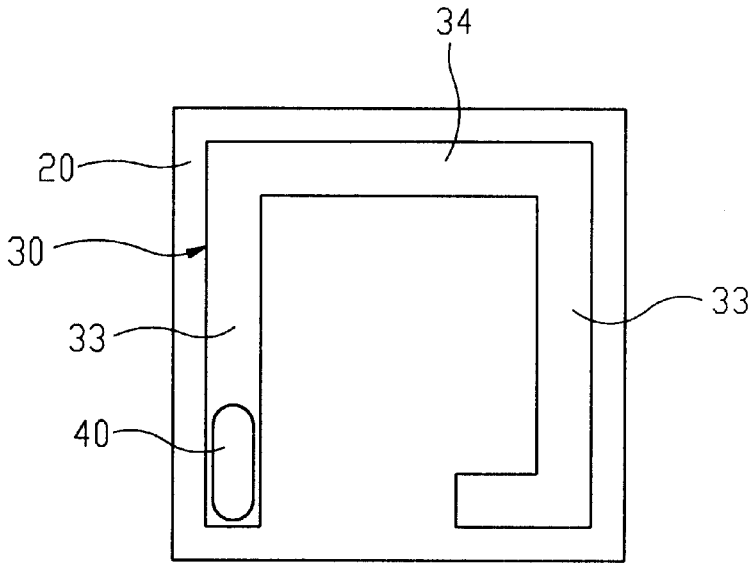
FIG. 6 presents a top planar view of a ferrite sheet of the laminated body shown in FIG. 5.
Figure 7:
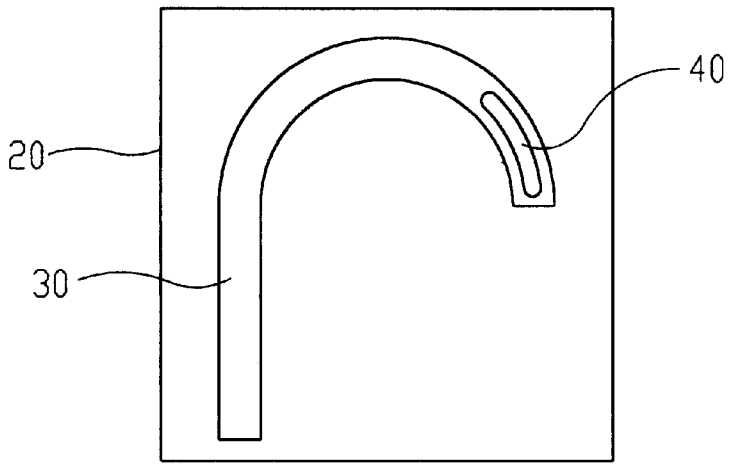
FIG. 7 shows a top planar view of another modification of the ferrite sheet.

Although, in the first embodiment of the present invention, the laminated inductor has the coil conductive pattern with one end opened, the shape of the pattern is not limited only to this. For example, as shown in FIGS. 5 and 6, it may be possible to extend the end of the branch 33 not having the elongated through-hole 40 along a line completing the rectangular shape of the coil conductive pattern 30, this configuration being capable of accommodating more serious misalignment between the ferrite sheets 20. Further, as shown in FIG. 7, the coil conductive pattern 30 may be formed to have a circular shape, with its elongated through-hole 40 having the circular shape. In this case, the elongated through-hole 40 is preferably formed by a laser based drilling.

Figure 8:
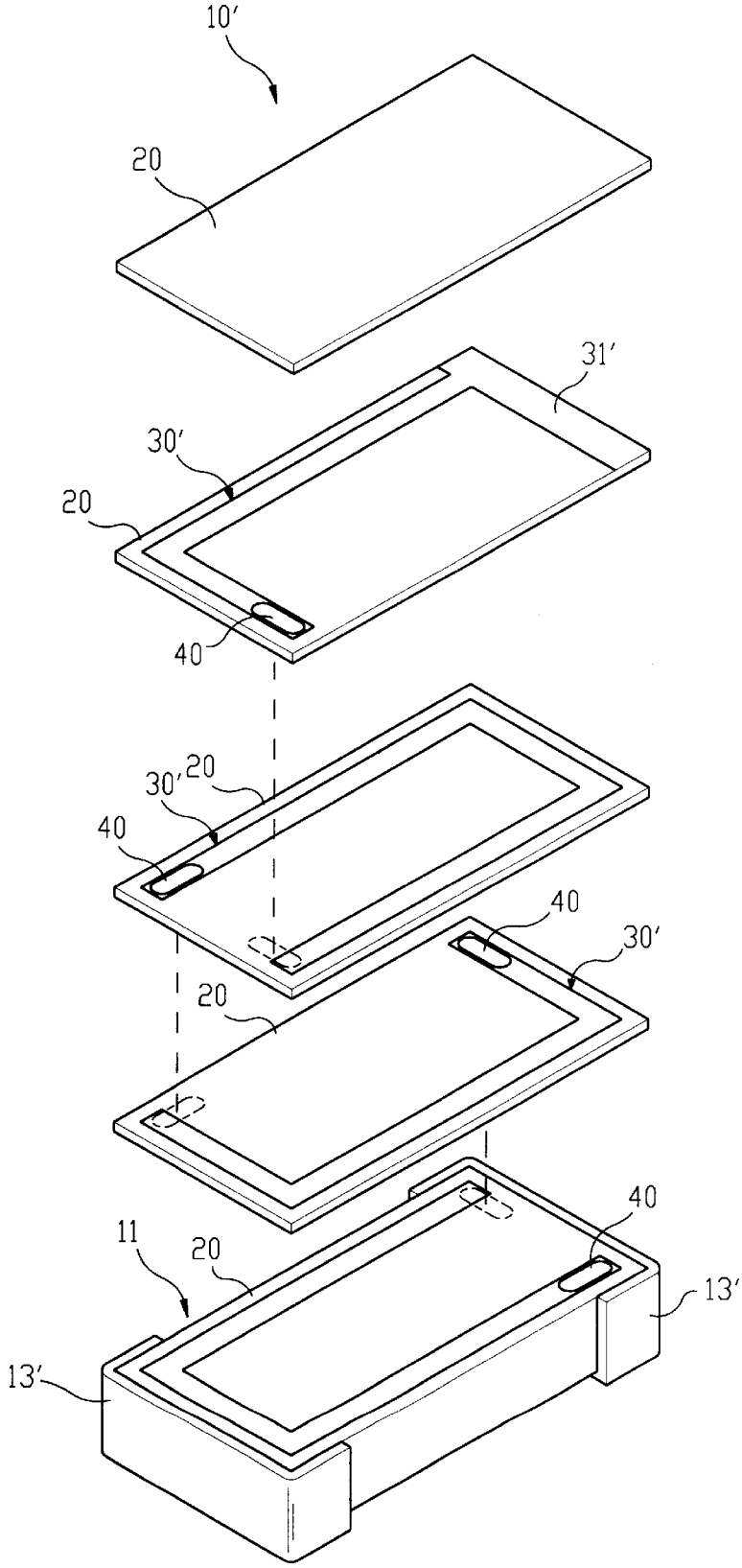
FIG. 8 shows an exploded perspective view of a laminated body of a laminated inductor in accordance with a second embodiment of the present invention.

Further, although the direction of the magnetic flux generated by the coil is parallel with the direction in which the external electrodes are connected in the first embodiment, the present invention is not limited to this. That is, the present invention may be a laminated inductor 10' shown in FIG. 8. FIG. 8 shows a partial exploded perspective view of the laminated inductor 10' in accordance with the second embodiment. As shown in FIG. 8, in the laminated inductor 10', a direction of a magnetic flux generated by the coil is at a right angle with a direction in which external electrodes 13' are connected. Further, in the laminated inductor 10', an uppermost ferrite sheet 20 has a coil conductive pattern 30' and a lead conductive inductor 31' extending from the coil conductive pattern 30' to be exposed at one end of the laminated body 11. The lead conductive inductor 31' is connected to one end of the external electrodes 13. In a similar manner, a portion of the coil conductive pattern on a lowermost ferrite sheet is exposed at the other end of the laminated body 11 to be electrically connected to the other end of the external electrodes 13. Forming the coil conductive pattern 30' and the elongated through-hole 40 is identical to that in the laminated inductor 10 described above.

Although the present invention was described about the laminated inductor as an example of the laminated electronic components, it can be also applied to, e.g., a laminated filter or an inductor array or all of the laminated electronic components in which a plurality of sheets or layers are electrically connected to one another via the through-hole. The present invention is more useful in a case when the direction of the magnetic flux is parallel to a direction in which the sheets are laminated.

As described above, since the elongated through-hole is a hole elongated along the length of the branch of the coil conductive pattern, the electrical connection between the coil conductive patterns or between the coil conductive pattern and the lead conductive pattern can be maintained without necessitating a land for connecting to the normal through-hole. For this reason, increasing of the floating capacitance or reduction of the self-resonant frequency which may occur due to an existence of the land can be prevented. This configuration can cover more serious degrees of misalignment between the ferrite sheets or layers, maintaining a sufficient contact area between the conductive patterns.

Although the invention has been shown and described with respect to the preferred embodiments, it will be understood by those skilled in the art that various changes and modifications may be made without departing from the spirit and scope of the invention as defined in the following claims.

What is claimed is:

1. A laminated electronic component having a plurality of insulating layers, each of the insulating layers comprising:

a stack of insulating layers, each of the insulating layers being provided with a conductive pattern having a linear shape with a predetermined width, the conductive pattern including a first end portion and a second end portion; and an elongated through-hole formed inside the first end portion, the elongated trough-hole being elongated along a lengthwise direction of the first end portion and having a width not greater than that of the conductive pattern, wherein conductive patterns of two neighboring insulating layers are electrically connected to each other via the elongated through-hole of one of the neighboring insulting layers and the second end portion of the other neighboring insulating layer.

2. The laminated electronic component of claim 1, wherein a lengthwise direction of the elongated through-hole of said one of the neighboring insulating layers is at a right angle with a lengthwise direction of the second end portion of the other neighboring insulating layer.

3. The laminated electronic component of claim 1, wherein the conductive patterns of the insulating layers form a coil.

4. The laminated electronic component of claim 2, wherein the conductive patterns of the insulating layers form a coil.

5. The laminated electronic component of claim 3, further comprising a pair of external electrodes being electronically connected to two ends of the coil, respectively. The external electrodes being located at two opposite end portions of the laminated electronic component along a stacking direction of the insulating.

6. The laminated electronic component of claim 3, further comprising a pair of external electrodes being electronically connected to two ends of the coil, respectively, the external electrodes being located at two opposite end portions of the laminated electronic component along a stacking direction of the insulating layers.

7. The laminated electronic component of claim 1, further comprising insulation layers having no conductive patterns thereon and being disposed on the uppermost insulating layer and under the lowermost insulating layer.

8. The laminated electronic component of claim 2, further comprising insulation layers having no conductive patterns thereon and being disposed on the uppermost insulating layer and under the lowermost insulating layer.

* * * * *